United States Patent [19]

Isaksson

[11] 3,995,101

[45] Nov. 30, 1976

[54] CYLINDRICAL ELONGATED FURNACE FOR TREATING MATERIAL AT HIGH TEMPERATURE IN A GASEOUS ATMOSPHERE UNDER HIGH PRESSURE

[75] Inventor: Sven Erik Isaksson, Robertsfors, Sweden

[73] Assignee: Allmanna Svenska Elektriska Aktiebolaget, Vasteras, Sweden

[22] Filed: June 5, 1975

[21] Appl. No.: 584,006

[30] Foreign Application Priority Data

Apr. 25, 1975 Sweden ..... 7504800

[52] U.S. Cl. ..... 13/20; 13/35; 13/31

[51] Int. Cl.[2] ..... F27D 1/00; H05B 3/00

[58] Field of Search ..... 13/20, 22, 25, 31, 35

[56] References Cited

UNITED STATES PATENTS

| | | | |
|---|---|---|---|
| 2,035,306 | 3/1936 | Fannin | 13/25 |
| 3,654,374 | 4/1972 | Scheyer | 13/31 |

*Primary Examiner*—R. N. Envall, Jr.
*Attorney, Agent, or Firm*—Watson, Cole, Grindle & Watson

[57] ABSTRACT

A cylindrical elongated furnace for treating material at high temperature in a gaseous atmosphere under high pressure includes a vertical cylindrical pressure chamber for confining gas under pressure and a furnace space surrounded by a cylindrical heater formed of electrical resistor elements and insulation surrounding the furnace space and the heater. The insulation is formed by a cylindrical insulating sheath. The heater is built up of ceramic elements which form a cylinder with annular channels for the electrical resistor elements and supporting insulation surrounding and holding the ceramic elements together, such insulation having a low gas permeability and being formed of several layers of a tight felt impregnated with a hardening component. The leads for the heating elements are flat vertical elements arranged on the outside of the ceramic elements and formed with one or more bights projecting into the annular channels to reduce the free hanging length of the leads.

7 Claims, 8 Drawing Figures

CYLINDRICAL ELONGATED FURNACE FOR TREATING MATERIAL AT HIGH TEMPERATURE IN A GASEOUS ATMOSPHERE UNDER HIGH PRESSURE

BACKGROUND OF THE INVENTION

1. Field of the Invention

The present invention relates to a cylindrical elongated vertical furnace for simultaneous treatment of material at high temperature, preferably above 1000° C in a gaseous atmosphere under high pressure, preferably above 500 bar.

THE PRIOR ART

Pressure furnaces involve many constructional problems compared with furnaces operating at atmospheric pressure or lower pressure. The furnace space must be enclosed in a pressure chamber capable of confining gas under high pressure. This means that the cost of the furnace per unit of volume will be high. The cost increases rapidly with increased pressure and increased pressure chamber diameter. This means that it is necessary to economize the space in the pressure chamber. The heating of the pressure chamber walls must be limited in view of the strength. In addition, the heat losses must be limited in order to achieve and maintain the desired treatment temperature with a reasonable supply of power. The insulation and the heater inside the pressure chamber between the furnace space and the walls of the pressure chamber must be designed with the least radial extension in order to obtain a maximum furnace space. Designing the furnaces so that a furnace space with a large diameter is obtained in the pressure chamber with a small diameter involves many difficult problems. In the U.S. Pat. Nos. 3,598,378, 3,628,779 and 3,790,339 pressure furnaces of various embodiments are further described. In all these furnaces there is a heater inside the insulation, which heater contains a metal tube with insulators supporting heating elements. In furnaces for very high temperatures, the heaters used so far have been found to possess certain drawbacks. Among other things, deformations have occurred which have led to short-circuits or other faults and which have made it difficult to exchange the heaters.

SUMMARY OF THE INVENTION

In the furnace according to the invention, a ceramic heater is used, which entails many advantages over the heaters used so far. It has an excellent stability of shape, and, provides greater freedom for the location of the heating elements and therefore better possibilities of maintaining an even temperature in the furnace space, and a better support for the heating elements and thus a reduced risk of deformation, shortcircuiting and rupture. In addition to this, it is provides a not inconsiderable contribution to the heat insulation and is easily serviceable. All this contributes to an improved economy with fewer breakdowns and reduced direct service expenses.

The heater is built up of ceramic elements which form a cylinder with annular channels for electric resistor elements and a support insulation surrounding the ceramic elements and holding them together, and support insulation having a low gas permeability and being built up of several layers of a thick felt which has been impregnated with a hardening component so that the layers are bonded together. This felt in one case consists substantially of aluminium silicate. The thickness is suitably from 1 to 3 mm and the support insulation suitably consists of from 3 to 10 layers of a total thickness of from 3 to 25 mm. The impregnating agent may consist of 10–25 % of a powder or liquid cement of fine-grained zirconium oxide suspended in a liquid hardener of the Triton (Trademark) or Carborundon (Trademark) QF 180 types. This bonding hardening element is applied to the felt in connection with this being wound on around the cylinder of the ceramic elements.

The individual ceramic elements are U-shaped and oriented in such a way that the web forms the bottom and the flanges form vertical walls in the annular channels for the heating elements, and inner and outer walls in the cylinder formed of the ceramic elements. The flanges of the ceramic elements form a substantially unbroken outer wall and an inner wall provided with openings. The number of openings is suitably equal to the number of ceramic elements. Together with the support insulation, the cylinder of the ceramic elements forms a cylinder having a low gas pemeability. At the bottom the heater is tightly connected to a supporting bottom so that a radial gas flow between the furnace space and the space outside the heater is effectively prevented. The heater itself contributes to the radial insulation. The difference in temperature between the furnace space and the space between the heater and the proper insulating sheath may amount to 200° C.

BRIEF DESCRIPTION OF THE DRAWINGS

The invention is described in more detail with reference to the accompanying drawings.

DESCRIPTION OF THE PREFERRED EMBODIMENTS

Figure 1:
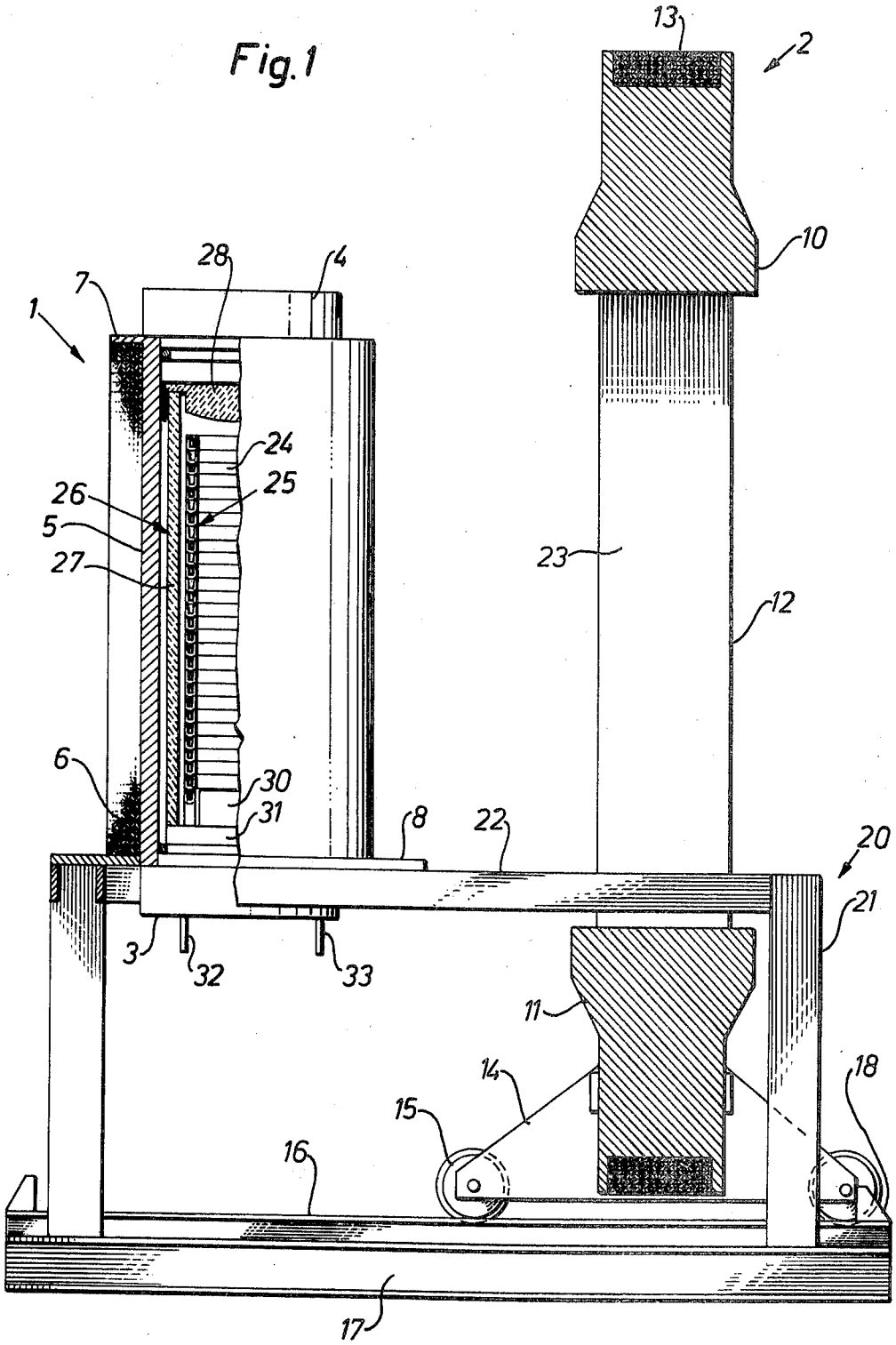
FIG. 1 shows a pressure furnace partly in cross-section, FIG. 2 on a larger scale a vertical section through a furnace insulation and a heater, FIG. 3 a perspective view and a section through a heater, FIG. 4 a horizontal section through the heater, FIGS. 5 and 6 on a larger scale a vertical and a horizontal section through the heater showing a connection between a lead and a heating element and FIGS. 7 and 8 a vertical and a horizontal section through the heater showing the bights (bends) of the leads and the attachment of a lead in the heater.

FIG. 1 shows a pressure furnace of the type which comprises a stationary pressure chamber 1 and a movable press stand 2 intended to take up forces operating on the end closures 3 and 4 of the pressure chamber. The pressure chamber is constructed with a high pressure cylinder which consists of a tube 5 surround by a force-absorbing strip sheath 6 and an upper end plate 7 and a lower end plate 8 intended to support the pressure chamber 1. The press stand 2 is built up of an upper yoke 10 and a lower yoke 11, intended to take up forces operating on the end closures 3 and 4, two spaces 12 and a surrounding strip sheath 13 holding it together. The press stand is supported by a frame 14 with rail wheels 15 running on rails 16 on a bottom plate 17. The movement is limited by an end stop 18. On the bottom plate there is a trestle-like supporting frame 20 consisting of four pillars 21 and two supporting beams 22 passing through the window opening 23 of the press stand. The lower end plate 8 of the press stand rests on these beams 22. In the pressure chamber 1 there are a furnace space 24, a heater 25, an insulating casing 26 which consists of an insulating sheath 27 with a removable lid 28 and an insulating bottom 30. The header 25 and the casing 26 are supported by a bottom plate 31. Between the end closures 3 and 4 and the tube 5 there are seals. Energy is supplied to the heater through the conductor 32. Measurement values from thermoelements are obtained through the conductor 33.

The insulation and the heater are described in more detail with reference to FIGS. 2 to 8.

The insulating sheath 27 consists of a lower metal ring 34, an outer tube 35, an upper metal ring 36, suspended tubes 37 and 38, a felt-like ceramic insulation 40 and 41 wound on the tubes 37 and 38 and strips which keep the insulation pressed against the tubes. The number of tubes and insulating layers is determined by the working temperature and working pressure of the furnace. The lid 28 consists of two plates with insulating material between them. The lid is provided with a flange projecting down into a slot in the ring 36 which may contain sealing material intended to prevent a gas flow between the lid and the ring 36 of the insulating sheath 27. Above the lid 28 there is applied a second lid 50 which consists of a plane plate 51 and a flange 52 extending down from said plate.

The heater 25 contains a supporting ring 60 on which there rests a cylinder which is built up of a large number of U-shaped ceramic bodies 61 and a support insulation 62 and strips 63 holding these together. The bodies 61 may be bow-shaped or straight with plane end surfaces 64 which form such an angle that the end planes intersect each other in the centre of a cylinder of the desired diameter. The webs 65 of the ceramic bodies form bottom and roof, respectively, and the flanges 66 and 67 form walls in annular channels 68 for heating elements 70. Said heating elements consist of folded strips, standing on end, of a material known per se suitable for the working temperature chosen. The flanges 67 form an outer substantially whole wall, whereas the flanges 66 are so formed that they form a wall with openings allowing the heat to radiate and flow out into the furnace space 24. The end portions of the flanges may be cut off or the flanges may be provided with holes. In the heater shown in the figures the end portions of the flanges are cut off so that openings 71 are formed at the joint between two ceramic bodies. The webs 65 of the ceramic bodies 61 are constructed with guide slots 72 bonding two layers of bodies in relation to each other. The retaining support insulation 62 of the heater consists of four layers **62*a*, 62*b*, 62*c* and 62*d* of sheet-like, ceramic felt-like material which is wound around the cylinder formed of the bodies 61. The layers are so arranged that an overlap of joints is obtained. When winding on the layers, a binder is applied on to the material. Said binder consists of a ceramic powder mixed in a liqud hardener which, during heating, bonds together the layers 62*a*, 62*b*, 62*c*, and 62*d* into a substantially homogeneous support insulation having a low gas permeability. In this way pressure medium is prevented from flowing radially through the heater from the furnace space 24 to the gap 73 between the heater 25 and the insulating sheath 27. The temperature difference between the furnace space and the gap may amount to a few hundred degrees. The heater therefore forms an integral part of the insulation around the furnace space. A temperature difference as high as 200° C between the furnace space 24 and the gap 73** involves a great pressure difference, and therefore a low gas permeability is necessary.

Figure 2:
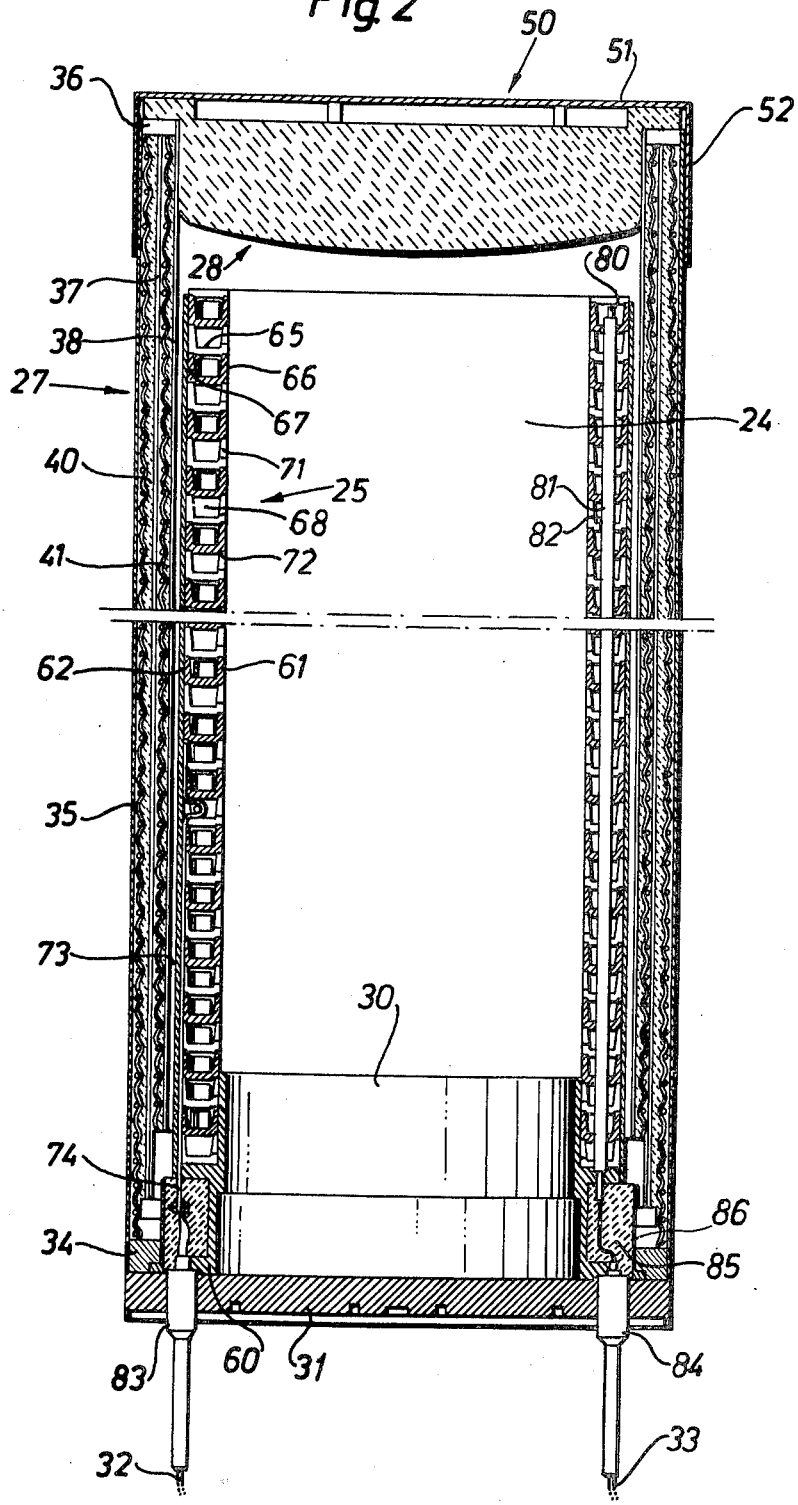
Figure 3:
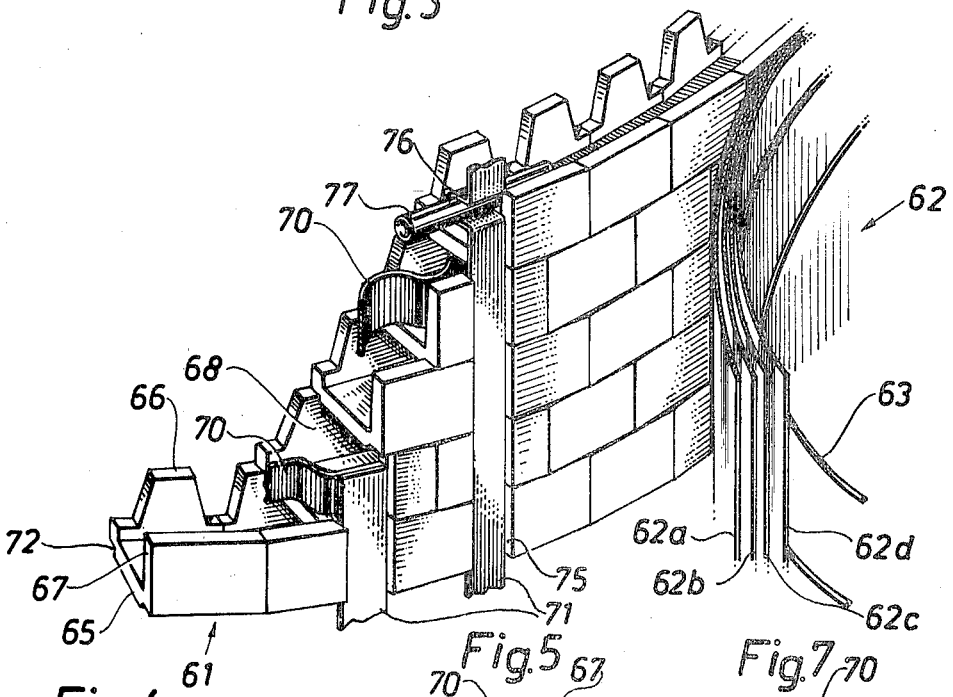
Figure 4:
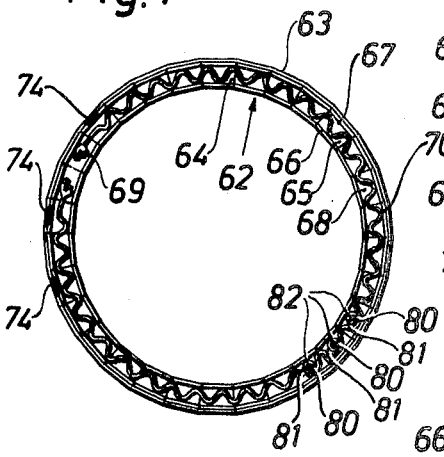
Figure 5:
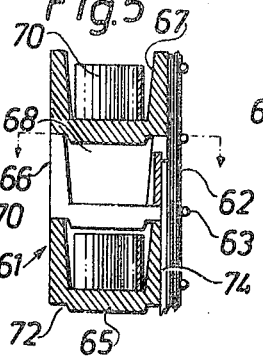
Figure 7:
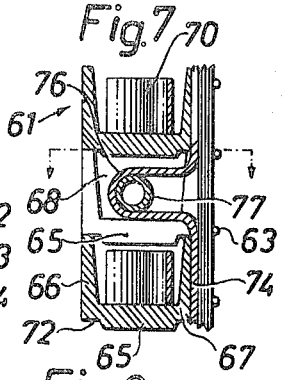
Figure 6:
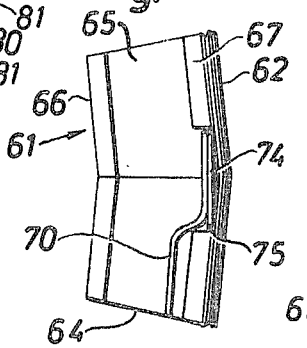
Figure 8:
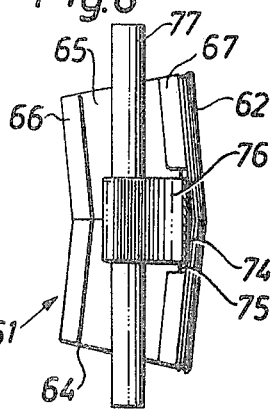

In order that an even temperature may be maintained in the furnace space the heating elements are divided up into several groups so that the supply of heat may be chosen differently for different zones. Furthermore, the heating elements may be placed closer at the lower part of the furnace than at the upper part because of the fact that the heat requirement is greatest at the lowermost part of the furnace space owing to the convection within the furnace space. As shown in FIG. 2, the heating elements 70 are arranged in each channel 68 at the lower part of the heater 25, but only in every second channel at its upper part. In the webs 65 of certain ceramic bodies 61 there are openings 69 for connection of a heating element 70 in a channel 68 to the heating element in another channel.

The leads 74 for feeding the heating elements 70 consist of flat strips which are arranged in slots 75 at the outer flanges 67 of the ceramic elements 61. The leads are thus located completely inside the support insulation 62. The leads are provided with bights 76 projecting into a channel 68 and there resting against the bottom of the channel formed by the web 65. The bight 76 is fixed in the channel 68 by a bolt 77. The free-hanging length and consequently the tensile strain in the leads are thus limited.

Thermocouples 80 are arranged in the ceramic tubes 81 passing through holes 82 in the webs of some of the U-shaped bodies.

The leads 74 and the thermocouples 80 are connected to lead-in wires 83 and 84 and these, in turn, are connected to the conductors 32 and 33. The annular space 85 which is formed between the ring 60 and ring 86 and where the leads 74 and the thermocouples 80 are joined to the connection 83 and 84 is filled with an insulating material 87.

I claim:

1. Cylindrical elongated furnace for treating material at high temperature in a gaseous atmosphere under high pressure, comprising a vertical cylindrical pressure chamber capable of confining gas under high pressure, a furnace space, a cylindrical heater surrounding the furnace space comprising electrical resistor elements, and insulation surrounding the furnace space and the heater and comprising a cylindrical, insulating sheath with an insulating lid and bottom, the heater being built up of ceramic elements forming a cylinder with annular channels for the electrical resistor elements, and a supporting insulation surrounding and holding the ceramic elements together, said supporting insulation having a low gas permeability and being built up from several layers of a tight felt impregnated with a hardening component, thus achieving bonding between the layers.

2. Furnace according to claim 1, in which the felt substantially consists of aluminium silicate.

3. Furnace according to claim 1, in which the supporting insulation consists of from 3 to 10 layers and has a thickness of from 3 to 25 mm.

4. Furnace according to claim 1, in which the hardening component consists essentially of from 10 to 25 per cent by weight of zirconium oxide (Teka cement) and Triton hardener.

5. Furnace according to claim 1, in which the ceramic elements are U-shaped and oriented so that the web forms the bottom and the flanges vertical walls in annular channels for the heating elements, and inner and outer walls in the cylinder formed of the ceramic element.

6. Furnace according to claim 5, in which the flanges of the ceramic element form a substantially tight outer wall and an inner wall having substantially as many openings as the ceramic elements.

7. Furnace according to claim 1, in which the heater is tightly connected to a supporting bottom so that a radial flow of gas between the spaces outside the heater and the furnace space is prevented.

* * * * *